US011805838B2

(12) United States Patent
Lewis

(10) Patent No.: US 11,805,838 B2
(45) Date of Patent: Nov. 7, 2023

(54) FOOTBALL HELMET ASSEMBLY

(71) Applicant: Timothy Lewis, Houston, TX (US)

(72) Inventor: Timothy Lewis, Houston, TX (US)

( * ) Notice: Subject to any disclaimer, the term of this patent is extended or adjusted under 35 U.S.C. 154(b) by 0 days.

(21) Appl. No.: 17/699,923

(22) Filed: Mar. 21, 2022

(65) Prior Publication Data

US 2023/0292874 A1 Sep. 21, 2023

(51) Int. Cl.
*A42B 3/22* (2006.01)
*A42B 3/06* (2006.01)

(52) U.S. Cl.
CPC . *A42B 3/22* (2013.01); *A42B 3/06* (2013.01)

(58) Field of Classification Search
CPC ..... A42B 3/122; A42B 3/221; A42B 3/222; A42B 3/22; A42B 3/064; A42B 3/06
USPC ..... 2/10, 15, 424
See application file for complete search history.

(56) References Cited

U.S. PATENT DOCUMENTS 3,543,308 A * 12/1970 Stapenhill ..... A42B 3/226 2/6.4
4,124,904 A * 11/1978 Matthes ..... A42B 3/122 2/413
4,729,132 A * 3/1988 Fierro ..... A42B 3/285 2/171.4
6,820,285 B2 11/2004 Bataille
8,719,967 B2 * 5/2014 Milsom ..... A42B 3/125 2/413
D752,821 S 3/2016 Bologna
D797,997 S 9/2017 Morin
10,561,191 B1 2/2020 Whitcomb
10,786,032 B2 9/2020 Hunt
2013/0014315 A1 1/2013 Valdez Diaz et al.
2013/0232668 A1 * 9/2013 Suddaby ..... A42B 3/064 2/413
2014/0317834 A1 10/2014 Power
2019/0133235 A1 5/2019 Domanskis
2020/0275721 A1 9/2020 Vanhoutin
2022/0125148 A1 * 4/2022 McDermott ..... A42B 3/20

FOREIGN PATENT DOCUMENTS

WO WO20206947 4/2020

* cited by examiner

*Primary Examiner* — Nathan E Durham
*Assistant Examiner* — Abby M Spatz

(57) ABSTRACT

A football helmet assembly includes a football helmet that is wearable on a user's head. An air bladder is positioned inside of the football helmet and the air bladder is inflatable with air to cushion the user's head against impact energy. An air pump is integrated into the football helmet to inflate the air bladder when the air pump is manipulated. A plurality of biasing units is each coupled between the football helmet and the air bladder to bias the air bladder away from the football helmet. A visor is movably integrated into the football helmet. The visor is positionable in stored position or a deployed position to cover the user's eyes. Furthermore, the visor is tinted to reduce intensity of light passing through the visor.

8 Claims, 6 Drawing Sheets

FOOTBALL HELMET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to helmet devices and more particularly pertains to a new helmet device for protecting a user's head while playing football and for facilitating the user to shield their eyes against sunlight. The device includes a football helmet that includes an air bladder that is inflatable to a desired degree of inflation for cushioning the user's head. The device includes a visor that is movably integrated into the football helmet. The visor is positionable in a stored position for concealing the visor or a deployed position to cover the user's eyes. The visor is tinted to reduce the intensity of light that passes through the visor.

(2) Description of Related Art Including Information Disclosed Under 37 CFR 1.97 and 1.98

The prior art relates to helmet devices including a variety of helmets that each has a visor mounted to an exterior of the helmet. The prior art discloses a helmet that has a plurality of gas charged cells for absorbing impact energy. The prior art discloses a helmet which has a visor slot integrated into an interior of the helmet and a visor that is retractable into the visor slot. The prior art discloses a helmet that has a plurality of shock absorbing elements integrated into the helmet for absorbing impact energy. The prior art discloses a helmet that has an air cushion and an air pump for inflating the air cushion.

BRIEF SUMMARY OF THE INVENTION

An embodiment of the disclosure meets the needs presented above by generally comprising a football helmet that is wearable on a user's head. An air bladder is positioned inside of the football helmet and the air bladder is inflatable with air to cushion the user's head against impact energy. An air pump is integrated into the football helmet to inflate the air bladder when the air pump is manipulated. A plurality of biasing units is each coupled between the football helmet and the air bladder to bias the air bladder away from the football helmet. A visor is movably integrated into the football helmet. The visor is positionable in stored position or a deployed position to cover the user's eyes. Furthermore, the visor is tinted to reduce intensity of light passing through the visor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
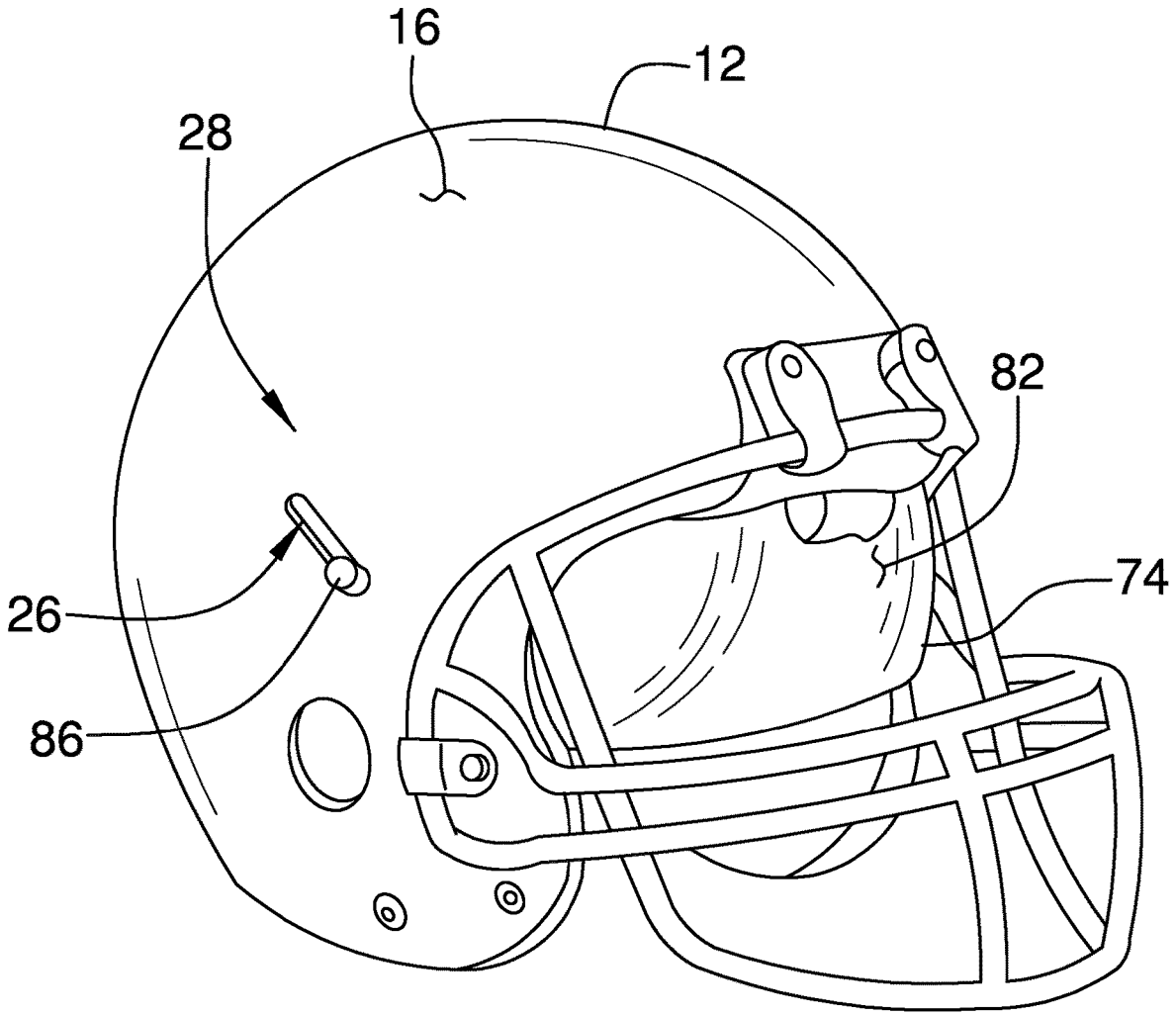
FIG. 1 is a front perspective view of a football helmet assembly according to an embodiment of the disclosure.
Figure 2:
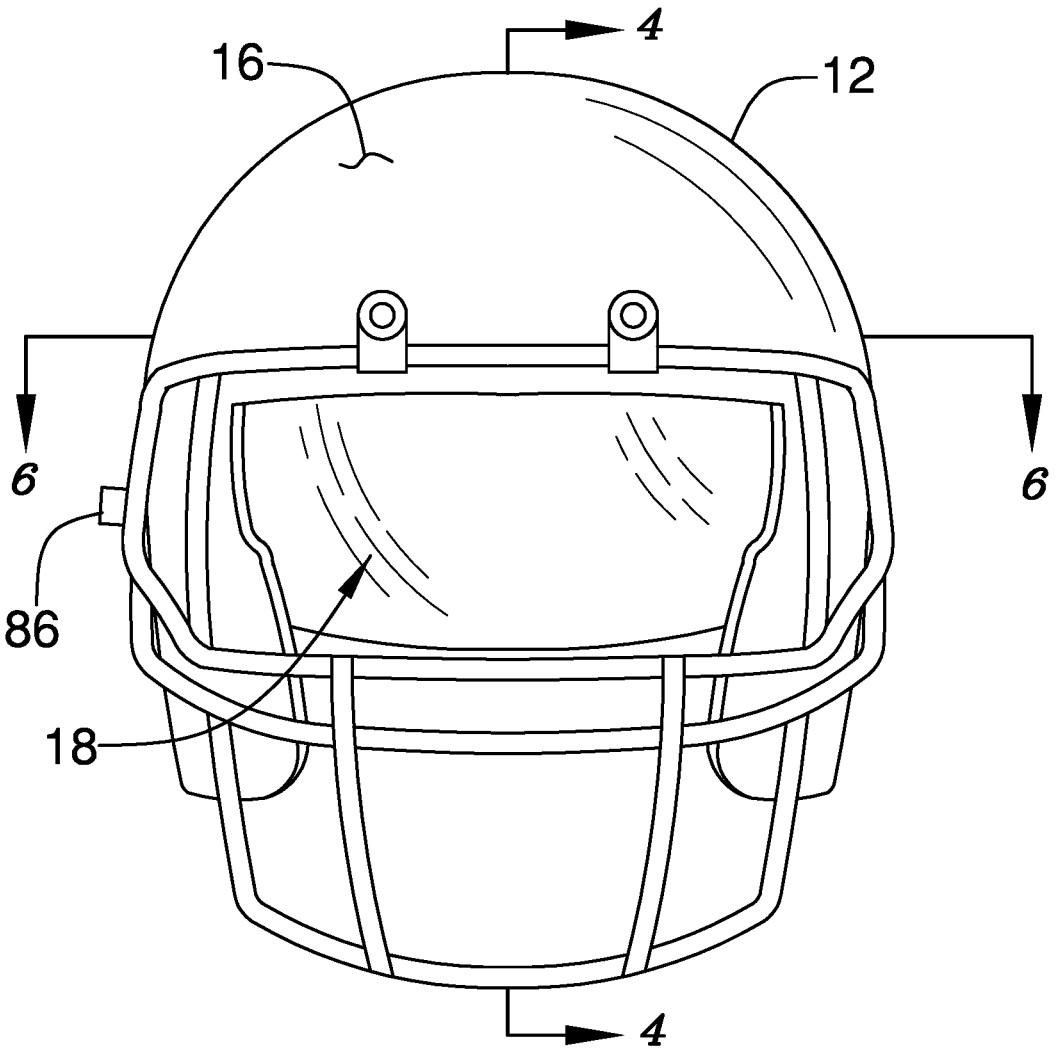
FIG. 2 is a front view of an embodiment of the disclosure.
Figure 3:
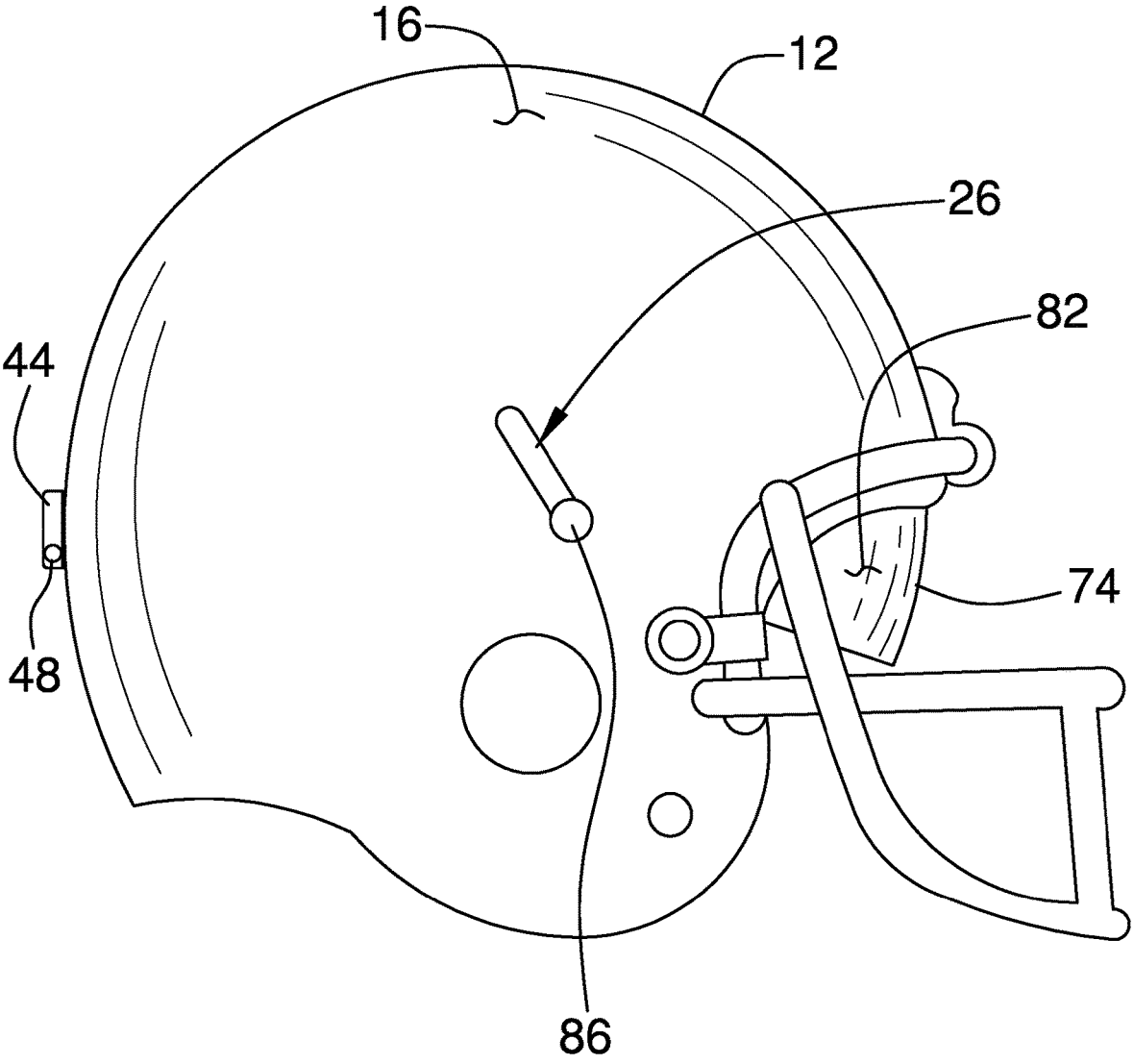
FIG. 3 is a right side view of an embodiment of the disclosure.
Figure 4:
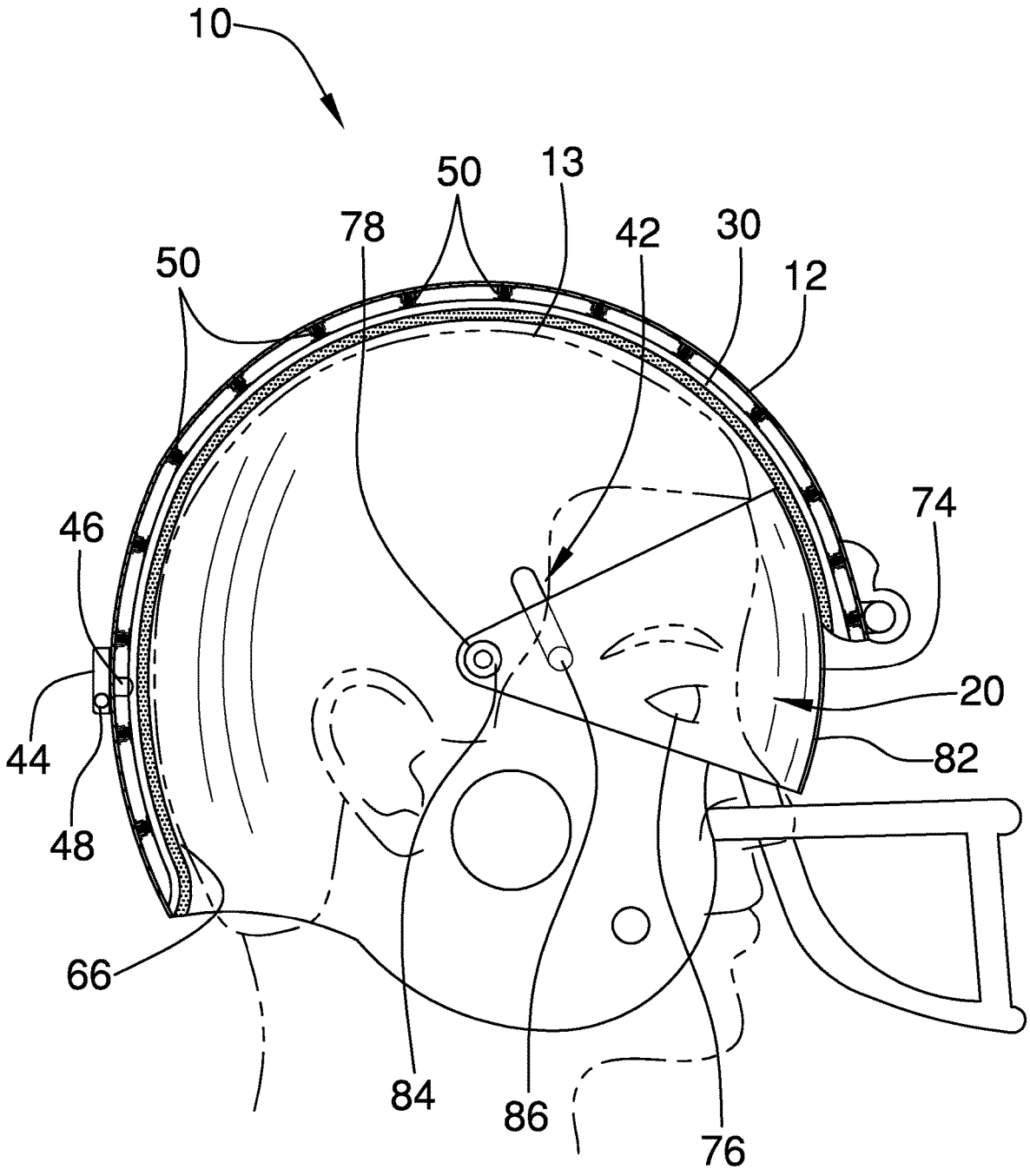
FIG. 4 is a cross sectional view taken along line 4-4 of FIG. 2 of an embodiment of the disclosure showing a visor in a deployed position.
Figure 5:
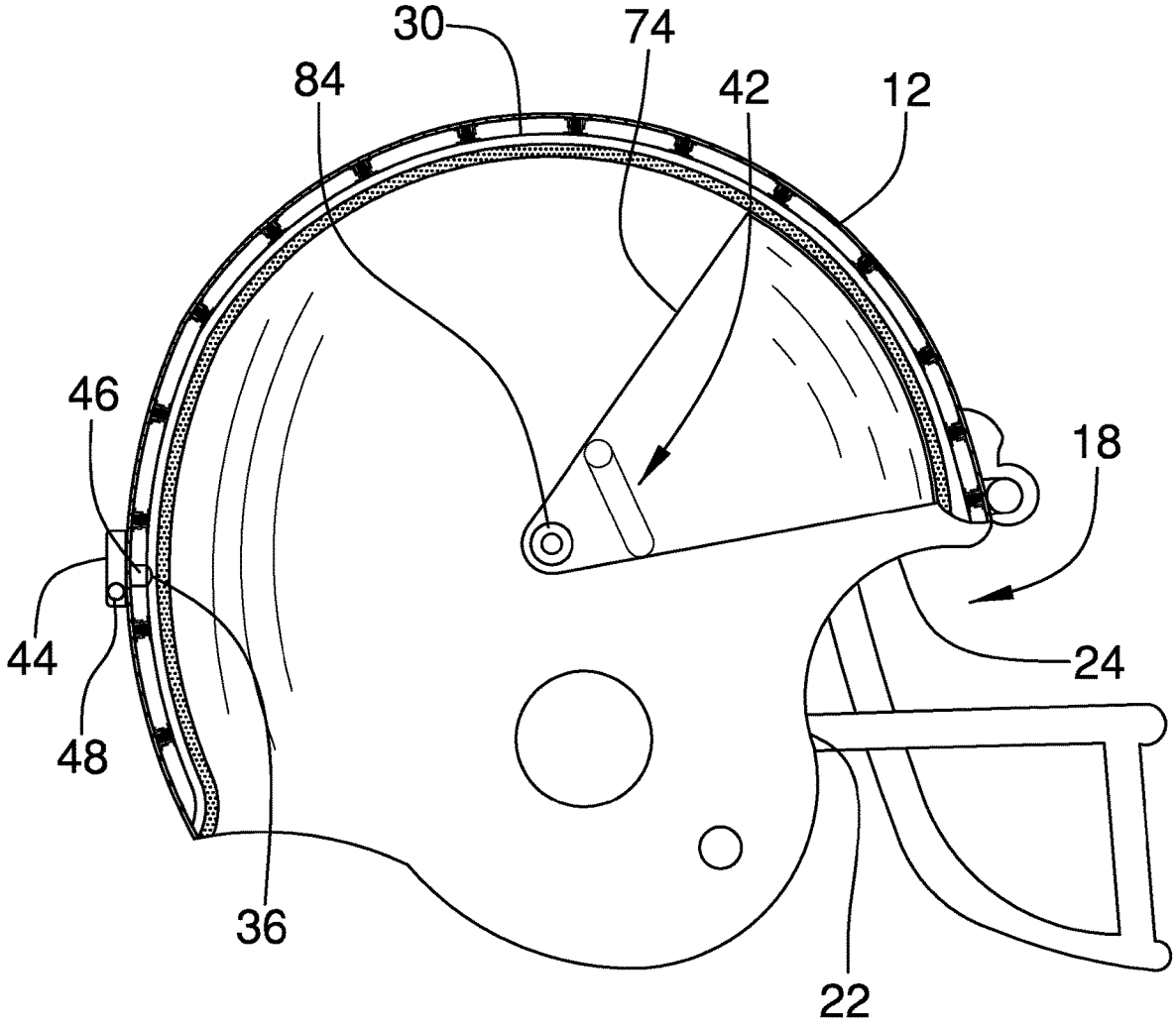
FIG. 5 is a cross sectional view taken along line 4-4 of FIG. 2 of an embodiment of the disclosure showing a visor in a stored position.
Figure 6:
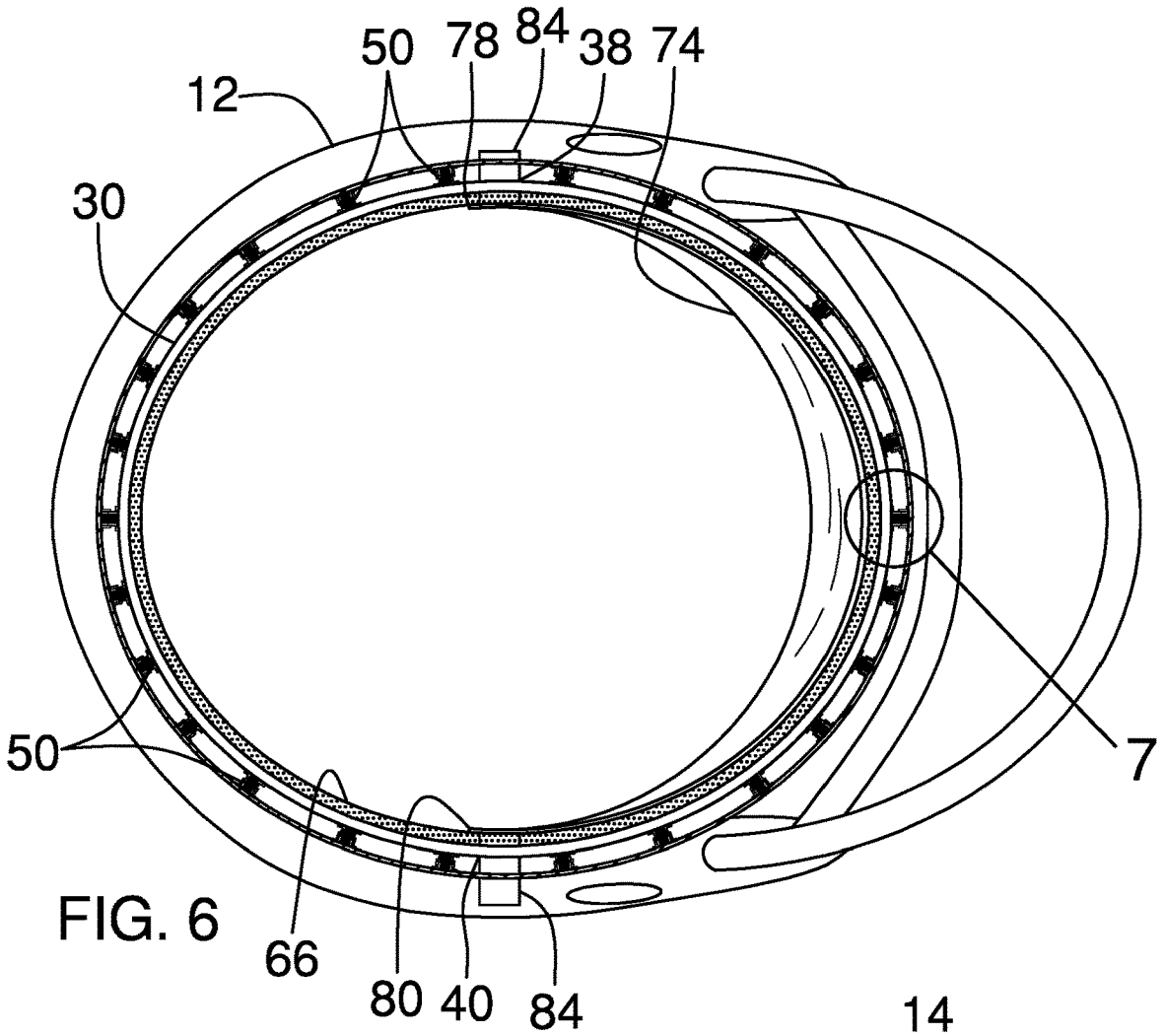
FIG. 6 is a cross sectional view taken along line 6-6 of FIG. 2 of an embodiment of the disclosure.
Figure 7:
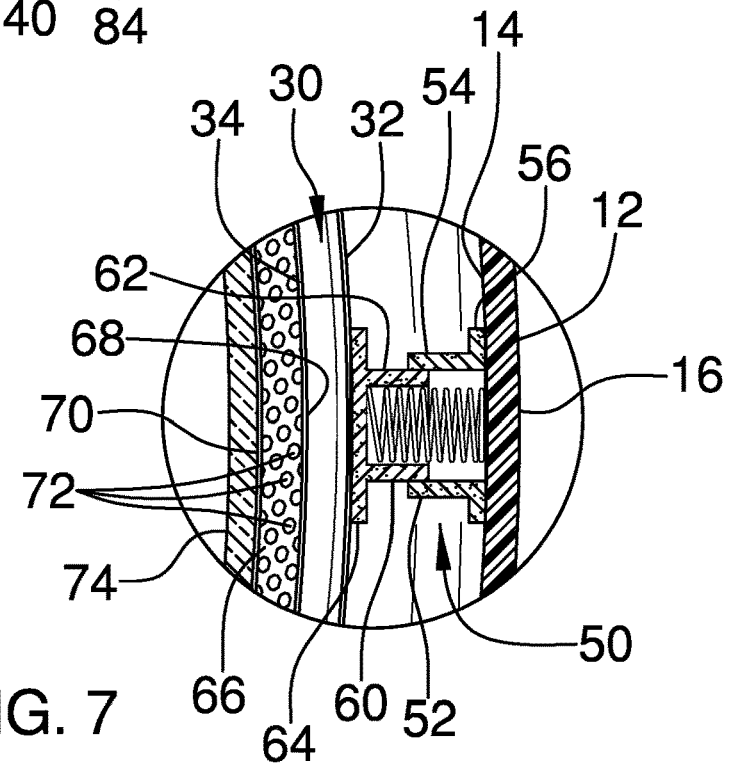
FIG. 7 is an enlarged detail view taken from circle 7 of FIG. 6 of an embodiment of the disclosure.

With reference now to the drawings, and in particular to FIGS. 1 through 7 thereof, a new helmet device embodying the principles and concepts of an embodiment of the disclosure and generally designated by the reference numeral 10 will be described.

As best illustrated in FIGS. 1 through 7, the football helmet assembly 10 generally comprises a football helmet 12 that is wearable on a user's head 13. The football helmet 12 has an inner surface 14 and an outer surface 16, and the football helmet 12 has a face opening 18 integrated into the football helmet 12 to expose the user's face 20 when the football helmet 12 is worn. The face opening 18 has a bounding edge 22 and the bounding edge 22 has an upper side 24. The football helmet 12 has a slot 26 extending through the inner surface 14 and the outer surface 16, and the slot 26 is positioned on a first lateral side 28 of the football helmet 12.

An air bladder 30 is positioned inside of the football helmet 12 and the air bladder 30 rests against the user's head 13 when the football helmet 12 is worn. The air bladder 30 is inflatable with air to cushion the user's head 13 against impact energy. Furthermore, the air bladder 30 has a top surface 32 and a bottom surface 34, and the top surface 32 is spaced from the inner surface 14 of the football helmet 12. The air bladder 30 is structured to conform to the shape of the football helmet 12 such that the top surface 32 completely covers the inner surface 14 of the football helmet 12. Additionally, the air bladder 30 has an air inlet 36.

The air bladder 30 has a first hole 38 extending through the top surface 32 and the bottom surface 34. Additionally, the air bladder 30 has a second hole 40 extending through the top surface 32 and the bottom surface 34. The air bladder 30 has a slot 42 extending through the top surface 32 and the bottom surface 34. Each of the first hole 38 and the second hole 40 is positioned on opposing sides of the air bladder 30 from each other, and the slot 42 in the air bladder 30 is positioned adjacent to the first hole 38. The air bladder 30 is sealed around each of the first hole 38, the second hole 40 and the slot 42 in the air bladder 30 to inhibit air from escaping the air bladder 30.

An air pump 44 is integrated into the football helmet 12 and the air pump 44 is in fluid communication with the air bladder 30. The air pump 44 inflates the air bladder 30 when the air pump 44 is manipulated. The air pump 44 is positioned on the outer surface 16 of the football helmet 12, the air pump 44 has an outlet 46 and the outlet 46 is fluidly coupled to the air inlet 36 of the air bladder 30. Additionally, the air pump 44 has a deflate valve 48 which is movably integrated into the air pump 44. The deflate valve 48 releases air from the air bladder 30 when the deflate valve 48 is manipulated into a deflate condition for deflating the air bladder 30. The air pump 44 may comprise a manually operated, mechanical air pump or the like and the deflate valve 48 may comprise an air valve that can either be opened or closed.

A plurality of biasing units 50 is provided and each of the biasing units 50 is coupled between the football helmet 12 and the air bladder 30 for attaching the air bladder 30 to the football helmet 12. Each of the biasing units 50 is compressible to facilitate the air bladder 30 to move toward the football helmet 12. Conversely, each of the biasing units 50 biases the air bladder 30 away from the football helmet 12. The biasing units 50 are spaced apart from each other and are distributed over an entirety of the football helmet 12. Each of the biasing units 50 comprises a first cup 52 that has an outer wall 54 and a flange 56 extending away from the outer wall 54. The flange 56 is coupled to the inner surface 14 of the football helmet 12 has the outer wall 54 extending away from the inner surface 14. Additionally, each of the biasing units 50 includes a biasing member 58 that is positioned inside of the first cup 52.

Each of the biasing units 50 includes a second cup 60 that has an outside wall 62 and a flange 64 extending away from the outside wall 62. The outside wall 62 has a diameter that is less than a diameter of the outer wall 54 of the first cup 52 such that the outside wall 62 extends into the first cup 52. The biasing member 58 extends into the second cup 60 and the biasing member 58 biasing the second cup 60 away from the first cup 52. The second cup 60 is urgeable toward the first cup 52 and the flange 64 of the second cup 60 is coupled to the top surface 32 of the air bladder 30.

A liner 66 is positioned over the air bladder 30 and the liner 66 is comprised of a resiliently compressible material to enhance comfort for the user. The liner 66 has a first surface 68 and a second surface 70, the first surface 68 is bonded to the bottom surface 34 of the air bladder 30 and the liner 66 completely covers the bottom surface 34. The liner 66 has a plurality of beads 72 that is each integrated into the liner 66 and each of the beads 72 is comprised of a resiliently compressible material. Furthermore, the liner 66 is comprised of a fluid resistant material to inhibit perspiration from passing through the liner 66 when the football helmet 12 is worn.

A visor 74 is provided and the visor 74 is movably integrated into the football helmet 12. The visor 74 is positionable in stored position having the visor 74 being concealed in the football helmet 12. Conversely, the visor 74 is positionable in a deployed position having the visor 74 being exposed to cover the user's eyes 76. The visor 74 is tinted to reduce intensity of light passing through the visor 74. The visor 74 has a first end 78, a second end 80 and a front surface 82 extending between the first end 78 and the second end 80, and the visor 74 is curved between the first end 78 and the second end 80 such that the visor 74 has a concave shape. Furthermore, the visor 74 tapers to a blunt point at each of the first end 78 and the second end 80.

The front surface 82 is spaced from the second surface 70 of the liner 66, and each of the first end 78 and the second end 80 is aligned with a respective one of the first hole 38 and the second hole 40 in the air bladder 30. The visor 74 has a pair of knobs 84 each extending away from the front surface 82 of the visor 74 and each of the knobs 84 is aligned with a respective one of the first end 78 and the second end 80 of the visor 74. Each of the knobs 84 extends through the liner 66 and each of the knobs 84 extends through a respective one of the first hole 38 and the second hole 40 in the air bladder 30. Additionally, each of the knobs 84 rotatably engages the inner surface 14 of the football helmet 12.

The visor 74 has a tab 86 extending away from the front surface 82 of the visor 74 and the tab 86 is positioned adjacent to a respective one of the knobs 84. The tab 86 extends through the liner 66 and the tab 86 extends through the slot 26 in the air bladder 30 and the slot 26 in the football helmet 12. In this way the tab 86 can be gripped for urging the visor 74 between the stored position and the deployed position. The visor 74 is positioned above the upper side 24 of the bounding edge 22 of the face opening 18 in the football helmet 12 when the visor 74 is positioned in the stored position. Furthermore, the visor 74 extends downwardly beyond the upper side 24 of the bounding edge 22 of the face opening 18 when the visor 74 is in the deployed position.

In use, the football helmet 12 is worn and the air pump 44 is manipulated to inflate the air bladder 30 to a desired degree of inflation, depending upon the user's preference. In this way the air bladder 30, the liner 66 and each of the biasing units 50 enhances impact protection for the user while playing the game of football. The tab 86 is gripped to urge the visor 74 into the deployed position in order to shield the user against intense sunlight. Conversely, the tab 86 is gripped to urge the visor 74 into the stored position when the user does not wish to employ the visor 74.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A football helmet assembly comprising:

a football helmet configured for being wearable on a user's head;

an air bladder being positioned inside of said football helmet, said air bladder being inflatable with air wherein said air bladder is configured to cushion the user's head against impact energy;

an air pump being integrated into said football helmet, said air pump being in fluid communication with said air bladder, said air pump inflating said air bladder when said air pump is manipulated;

a plurality of biasing units, each of said biasing units being coupled between said football helmet and said air bladder for attaching said air bladder to said football helmet, each of said biasing units being compressible to facilitate said air bladder to move toward said football helmet, each of said biasing units biasing said air bladder away from said football helmet, said biasing units being spaced apart from each other and being distributed over said football helmet;

a liner being positioned over said air bladder, said liner being comprised of a resiliently compressible material wherein said liner is configured to enhance comfort for the user;

a visor being movably integrated into said football helmet, said visor being positionable in stored position having said visor being concealed in said football helmet, said visor being positionable in a deployed position having said visor being exposed wherein said visor is configured to cover the user's eyes, said visor being tinted wherein said visor is configured to reduce intensity of light passing through said visor;

wherein said football helmet has an inner surface and an outer surface, said football helmet having a face opening being integrated into said football helmet wherein said face opening is configured to expose the user's face when said football helmet is worn, said face opening having a bounding edge, said bounding edge having an upper side, said football helmet having a slot extending through said inner surface and said outer surface, said slot being positioned on a first lateral side of said football helmet;

wherein said air bladder has a top surface and a bottom surface, said top surface being spaced from said inner surface of said football helmet, said air bladder being structured to conform to the shape of said football helmet such that said top surface completely covers said inner surface of said football helmet, said air bladder having an air inlet;

wherein said air bladder has a first hole extending through said top surface and said bottom surface;

wherein said air bladder has a second hole extending through said top surface and said bottom surface;

wherein said air bladder has a slot extending through said top surface and said bottom surface; and wherein each of said first hole and said second hole is positioned on opposing sides of said air bladder from each other, said slot in said air bladder being positioned adjacent to said first hole, said air bladder being sealed around each of said first hole, said second hole and said slot in said air bladder to inhibit air from escaping said air bladder.

2. The assembly according to claim 1, wherein said air pump is positioned on said outer surface of said football helmet, said air pump having an outlet, said outlet being fluidly coupled to said air inlet of said air bladder, said air pump having a deflate valve being movably integrated into said air pump, said deflate valve releasing air from said air bladder when said deflate valve is manipulated into a deflate condition for deflating said air bladder.

3. The assembly according to claim 1, wherein each of said biasing units comprises:

a first cup having an outer wall and a flange extending away from said outer wall, said flange being coupled to said inner surface of said football helmet having said outer wall extending away from said inner surface;

a biasing member being positioned inside of said first cup; and a second cup having an outside wall and a flange extending away from said outside wall, said outside wall having a diameter being less than a diameter of said outer wall of said first cup such that said outside wall extends into said first cup, said biasing member extending into said second cup, said biasing member biasing said second cup away from said first cup, said second cup being urgeable toward said first cup, said flange of said second cup being coupled to said top surface of said air bladder.

4. The assembly according to claim 1, wherein said liner has a first surface and a second surface, said first surface being bonded to said bottom surface of said air bladder, said liner completely covering said bottom surface, said liner having a plurality of beads each being integrated into said liner, each of said beads being comprised of a resiliently compressible material.

5. The assembly according to claim 4, wherein said visor has a first end, a second end and a front surface extending between said first end and said second end, said visor being curved between said first end and said second end such that said visor has a concave shape, said visor tapering to a blunt point at each of said first end and said second end, said front surface being spaced from said second surface of said liner, each of said first end and said second end being aligned with a respective one of said first hole and said second hole in said air bladder.

6. The assembly according to claim 5, wherein said visor has a pair of knobs each extending away from said front surface of said visor, each of said knobs being aligned with a respective one of said first end and said second end of said visor, each of said knobs extending through said liner, each of said knobs extending through a respective one of said first hole and said second hole in said air bladder, each of said knobs rotatably engaging said inner surface of said football helmet.

7. The assembly according to claim 6, wherein said visor has a tab extending away from said front surface of said visor, said tab being positioned adjacent to a respective one of said knobs, said tab extending through said liner, said tab extending through said slot in said air bladder and said slot in said football helmet wherein said tab is configured to be gripped for urging said visor between said stored position and said deployed position, said visor being positioned above said upper side of said bounding edge of said face opening in said football helmet when said visor is positioned in said stored position, said visor extending downwardly beyond said upper side of said bounding edge of said face opening when said visor is in said deployed position.

8. A football helmet assembly comprising:

a football helmet being wearable on a user's head, said football helmet having an inner surface and an outer surface, said football helmet having a face opening being integrated into said football helmet wherein said face opening is configured to expose the user's face when said football helmet is worn, said face opening having a bounding edge, said bounding edge having an upper side, said football helmet having a slot extending through said inner surface and said outer surface, said slot being positioned on a first lateral side of said football helmet;

an air bladder being positioned inside of said football helmet, said air bladder being inflatable with air wherein said air bladder is configured to cushion the user's head against impact energy, said air bladder having a top surface and a bottom surface, said top surface being spaced from said inner surface of said football helmet, said air bladder being structured to conform to the shape of said football helmet such that said top surface completely covers said inner surface of said football helmet, said air bladder having an air inlet, said air bladder having a first hole extending through said top surface and said bottom surface, said air bladder having a second hole extending through said top surface and said bottom surface, said air bladder having a slot extending through said top surface and said bottom surface, each of said first hole and said second hole being positioned on opposing sides of said air bladder from each other, said slot in said air bladder being positioned adjacent to said first hole, said air bladder being sealed around each of said first hole, said second hole and said slot in said air bladder to inhibit air from escaping said air bladder;

an air pump being integrated into said football helmet, said air pump being in fluid communication with said air bladder, said air pump inflating said air bladder when said air pump is manipulated, said air pump being positioned on said outer surface of said football helmet, said air pump having an outlet, said outlet being fluidly coupled to said air inlet of said air bladder, said air pump having a deflate valve being movably integrated into said air pump, said deflate valve releasing air from said air bladder when said deflate valve is manipulated into a deflate condition for deflating said air bladder;

a plurality of biasing units, each of said biasing units being coupled between said football helmet and said air bladder for attaching said air bladder to said football helmet, each of said biasing units being compressible to facilitate said air bladder to move toward said football helmet, each of said biasing units biasing said air bladder away from said football helmet, said biasing units being spaced apart from each other and being distributed over said football helmet, each of said biasing units comprising:

a first cup having an outer wall and a flange extending away from said outer wall, said flange being coupled to said inner surface of said football helmet having said outer wall extending away from said inner surface;

a biasing member being positioned inside of said first cup; and a second cup having an outside wall and a flange extending away from said outside wall, said outside wall having a diameter being less than a diameter of said outer wall of said first cup such that said outside wall extends into said first cup, said biasing member extending into said second cup, said biasing member biasing said second cup away from said first cup, said second cup being urgeable toward said first cup, said flange of said second cup being coupled to said top surface of said air bladder;

a liner being positioned over said air bladder, said liner being comprised of a resiliently compressible material wherein said liner is configured to enhance comfort for the user, said liner having a first surface and a second surface, said first surface being bonded to said bottom surface of said air bladder, said liner completely covering said bottom surface, said liner having a plurality of beads each being integrated into said liner, each of said beads being comprised of a resiliently compressible material; and a visor being movably integrated into said football helmet, said visor being positionable in stored position having said visor being concealed in said football helmet, said visor being positionable in a deployed position having said visor being exposed wherein said visor is configured to cover the user's eyes, said visor being tinted wherein said visor is configured to reduce intensity of light passing through said visor, said visor having a first end, a second end and a front surface extending between said first end and said second end, said visor being curved between said first end and said second end such that said visor has a concave shape, said visor tapering to a blunt point at each of said first end and said second end, said front surface being spaced from said second surface of said liner, each of said first end and said second end being aligned with a respective one of said first hole and said second hole in said air bladder, said visor having a pair of knobs each extending away from said front surface of said visor, each of said knobs being aligned with a respective one of said first end and said second end of said visor, each of said knobs extending through said liner, each of said knobs extending through a respective one of said first hole and said second hole in said air bladder, each of said knobs rotatably engaging said inner surface of said football helmet, said visor having a tab extending away from said front surface of said visor, said tab being positioned adjacent to a respective one of said knobs, said tab extending through said liner, said tab extending through said slot in said air bladder and said slot in said football helmet wherein said tab is configured to be gripped for urging said visor between said stored position and said deployed position, said visor being positioned above said upper side of said bounding edge of said face opening in said football helmet when said visor is positioned in said stored position, said visor extending downwardly beyond said upper side of said bounding edge of said face opening when said visor is in said deployed position.

* * * * *